United States Patent [19]

Izumida et al.

[11] Patent Number: 4,833,364

[45] Date of Patent: May 23, 1989

[54] ELECTRON GUN FOR COLOR PICTURE TUBES HAVING UNIQUELY FORMED LENS APERTURES

[75] Inventors: Yukihiro Izumida, Mobara; Shoji Shirai, Koganei; Hidemasa Komoro, Chosei; Kazuo Majima; Akio Yamaguchi, both of Mobara, all of Japan

[73] Assignee: Hitachi, Ltd., Tokyo, Japan

[21] Appl. No.: 718,855

[22] Filed: Apr. 2, 1985

[30] Foreign Application Priority Data

Apr. 4, 1984 [JP] Japan ..... 59-65706
Apr. 4, 1984 [JP] Japan ..... 59-65707
Apr. 4, 1984 [JP] Japan ..... 59-65708

[51] Int. Cl.[4] ..... H01J 29/56
[52] U.S. Cl. ..... 313/414; 313/437
[58] Field of Search ..... 313/412, 413, 414, 425, 313/426, 437

[56] References Cited

U.S. PATENT DOCUMENTS 4,301,473 4/1983 Endoh et al. ..... 313/414
4,542,318 9/1985 Say ..... 313/414
4,591,755 5/1986 Kornaker ..... 313/414 X
4,614,894 9/1986 Izumida ..... 313/414

*Primary Examiner*—Leo H. Boudreau
*Assistant Examiner*—K. Wieder
*Attorney, Agent, or Firm*—Charles E. Pfund

[57] ABSTRACT

An electron gun for a color picture tube has at least a cathode, a control grid, an accelerating grid, a focus grid and an anode, each of which has three apertures aligned in line. The focus grid and the anode made of elongated plates serves as main lens electrodes, and the apertures of the focus grid and the anode constitute a main lens assembly. The three apertures of each of the elongated plates has a central aperture defined by two first curves arcuated outward, two side apertures each of which is defined by a second curve as an inner half arcuated inward and a third curve as an outer half arcuated outward, the first and second curves being less arcuated than the third curve. The three apertures are aligned such that the major axes thereof are parallel to a shorter axis of the elongated plate and are located at equal intervals. The three apertures are spaced apart from each other through corresponding bridge portions. The third curve of each of the two side apertures is apart from a corresponding end of the elongated plate along the longitudinal direction.

16 Claims, 8 Drawing Sheets

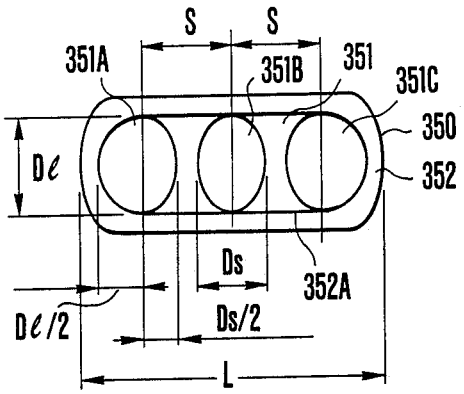
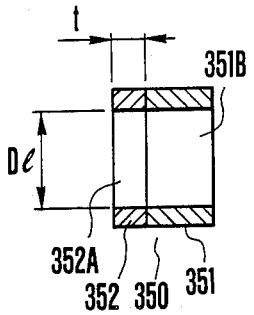
FIG.11A FIG.11B
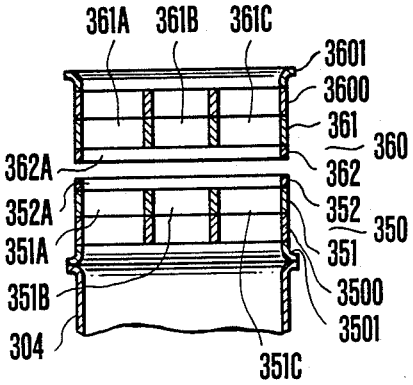
FIG.12
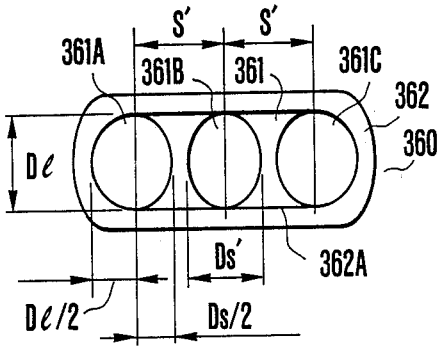
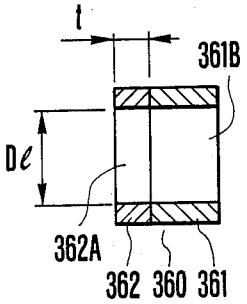
FIG.13A FIG.13B

ELECTRON GUN FOR COLOR PICTURE TUBES HAVING UNIQUELY FORMED LENS APERTURES

BACKGROUND OF THE INVENTION

The present invention relates to an electron gun for a color picture tube and, more particularly, to an in-line electron gun for a color picture tube, wherein focusing characteristics are improved.

In general, a main lens diameter of an electron gun for a color picture tube greatly influences the focusing characteristics. In order to obtain best focusing characteristics, the main lens diameter must be maximized, and mechanical strength must be increased to prevent deformation of the electron gun during assembly.

FIG. 1 is a sectional view showing the main part of a conventional bipotential focusing type in-line electron gun. Reference numerals 1A, 1B and 1C denote cathodes for emitting electron beams from their front ends, respectively; 2, a first grid for controlling the electron beams; 3, a second grid for accelerating the electron beams; and 4, a lower third grid for focusing the electron beams. Reference numerals 2A, 2B and 2C, 3A, 3B and 3C and 4A, 4B and 4C denote apertures for transmitting the corresponding beams therethrough. Reference numeral 5 denotes an upper third grid; and 6, a fourth grid, serving as an anode. Three apertures 5A, 5B and 5C of the upper focus grid 5 oppose three apertures 6A, 6B and 6C of the anode 6 to constitute three main lenses for the electron beams. In this case, operating voltages of 0 V, about 700 V, about 7 kV and about 25 kV are applied to the control grid 2, the accelerating grid 3, the lower and upper focus grids 4 and 5, and the anode 6, respectively.

With the above arrangement, signal potentials at the cathodes 1A, 1B and 1C determine intensities of electron beams, respectively. Three intensity-controlled electron beams A, B and C are slightly focused by prefocus lenses formed by the opposing apertures of the accelerating and lower focus grids 3 and 4. Thereafter, the electron beams are focused by the main lenses constituted by the upper focus grid 5 and the anode 6. The electron beams are focused on a phosphor screen (not shown) of a picture tube. At the same time, the side electron beams A and C are deflected inward at an angle $\theta$ by means of the apertures 6A and 6C of the anode 6 which are eccentric slightly outward with respect to the apertures 5A and 5C of the upper focus grid 5, thereby converging the electron beams A, B and C to one point. The upper focus grid 5 and anode 6 cannot comprise identical components, resulting in an increase in number of components. In addition, an eccentric assembly jig is required. It should be noted that reference numeral 7 denotes a shield cup.

In a conventional electron gun having the above arrangement, a size of a beam spot (i.e., focusing characteristics) on a phosphor screen of a picture tube must be minimized so as not to degrade sharpness of an image. In order to improve the focusing characteristics, the main lens diameter is conventionally increased.

FIG. 2 is a plan view showing the main part of the upper surface of the upper focus grid 5. Referring to FIG. 2, the three apertures 5A, 5B and 5C each having a diameter D are aligned in line at equal pitches S. As described above, in order to improve the focusing characteristics, the diameter D of each of the apertures 5A, 5B and 5C must be increased. However, the apertures

5A, 5B and 5C of the upper focus grid 5 obtained by pressing a nonmagnetic metal plate such as a stainless steel plate having a thickness of about 0.3 mm must have an aperture structure to increase the withstand voltage between the grid 5 and the anode 6. An aperture depth l must be larger than $\frac{1}{2}$ the diameter D to prevent degradation of rotation symmetry of the main lens electric field. The diameter D is smaller by 0.8 to 1.0 mm than the pitch S due to tooling restriction. When the pitch S is increased, convergence errors are increased on the respective dots of the phosphor screen while the picture tube is being operated. A dimension L of the upper focus grid 5 or the anode 6 which constitute the main lenses along the horizontal direction is increased. As a result, the electron gun housed in the bulb is located excessively near the inner surface of the neck, thereby degrading the withstand voltage characteristics.

It is assumed that any error in roundness (major axis-minor axis) of each aperture preferably falls within about 0.5% of the diameter D. For this reason, the electron gun is assembled so that each grid is held on a jig with three core pins (not shown) respectively fitted in the apertures and that heated multiform glass 8 is compressed on a support 9. In this case, each core pin has a diameter smaller by 0.02 to 0.03 mm than the diameter D since errors are present in the pitch S and the diameter D. The manufacturing errors of the respective grids and the deformation of the cup-like body caused by stress upon compression of the multiform glass 8 influence the apertures 5A, 5B and 5C. In a worst case, error in roundness measured upon removal of the grid from the jig is about 0.05 mm. When the diameter D is given as 3.9 mm, the error in roundness is about 1.3%. In this manner, when the error in roundness exceeds tolerance, the electric field of the main lens is distorted, and astigmatism occurs, thereby degrading the focusing characteristics.

FIG. 3 is a sectional view showing the main part of another in-line electron gun having a multi-stage main lens structure. In order to obtain best focusing characteristics in this electron gun, the diameter of an output (i.e., a final stage) main lens must be increased since the electron beam diameter is the largest. Referring to FIG. 3, reference numerals 21A, 21B and 21C denote cathodes for emitting electron beams A, B and C from their front ends; 22, a first grid for controlling the electron beams A, B and C; 23, a second grid for accelerating the electron beams A, B and C; 24, a third grid assembly which comprises a lower third grid 25 and an upper third grid 26; 27, a fourth grid; 28, a fifth grid assembly which comprises a lower fifth grid 29 and an upper fifth grid 30; and 31, a sixth grid. Each grid has three apertures. With this construction, operating voltages of 0 V, about 700 V, about 7 kV and about 25 kV are applied to the first grid 22, the second grid 23, the third and fifth grid assemblies 24 and 28, and the fourth and sixth grids 27 and 31, respectively, in the same manner as in the conventional electron gun described above.

The electron beams A, B and C are slightly focused by prefocus lenses constituted by apertures 23A, 23B and 23C of the second grid 23 and apertures 25A, 25B and 25C of the lower third grid 25. Thereafter, the electron beams are focused by a first main lens assembly $L_1$ constituted by apertures 26A, 26B and 26C of the upper third grid 26, apertures 27A, 27B and 27C of the fourth grid 27 and apertures 29A, 29B and 29C of the lower fifth grid 29. The electron beams focused by the first main lens assembly $L_1$ are focused again by a second main lens assembly $L_2$ constituted by apertures 30A, 30B and 30C of the upper fifth grid and opposing apertures 31A, 31B and 31C of the sixth grid 31. These beams are focused on a phosphor screen (not shown) of a picture tube. In the same manner as described with reference to the first conventional electron gun, the three electron beams are converged to one point. Reference numeral 32 denotes a shield cup.

FIG. 4 is a plan view showing the main part of the upper surface of the upper fifth grid 30 as the final stage of the second main lens assembly $L_2$. Referring to FIG. 4, the apertures 30A, 30B and 30C are aligned in line at equal pitches S. As described above, in order to improve the focusing characteristics, the diameter D of each of the apertures 30A, 30B and 30C of the fifth grid as the final stage of the main lens unit must be increased.

However, when the edge of the elliptical upper fifth grid 30 comes closer to the inner surface of the neck of the bulb having the electron gun therein, the withstand voltage characteristics are degraded. Therefore, a major axis L of the grid 30 cannot be increased. However, when the diameter of each of the apertures 30A, 30B and 30C is increased without increasing the major axis L, a bridge length d1 between the adjacent apertures is decreased although the length d1 must be more than 0.8 to 1.0 mm. In addition, a distance d2 between the side apertures 30A and 30C the grid periphery along the major axis is decreased. As a result, pressing cannot be easily performed. In addition, the decrease in distance d2 degrades the shielding effect against a change in potential at the inner wall surface of the neck upon operation of the picture tube. The side electron beams A and C are deflected over time to cause convergence errors, and the main lens diameter cannot be easily increased.

SUMMARY OF THE INVENTION

It is, therefore, an object of the present invention to provide an in-line electron gun for a color picture tube, wherein the conventional problems are substantially eliminated, the main lens diameter can be increased, assembly precision of the electron gun is improved, and focusing characteristics are improved.

It is another object of the present invention to provide an in-line electron gun with a multi-stage main lens structure for a color picture tube.

In order to achieve the above objects of the present invention, there is provided an electron gun for a color picture tube, having at least a cathode, a control grid, an accelerating grid, a focus grid and an anode, each of which has three apertures aligned in line, the focus grid and the anode made of elongated plates serving as main lens electrodes, and the apertures of the focus grid and the anode constituting a main lens assembly, wherein the three apertures of each of the elongated plates comprise a central aperture defined by two first curves arcuated outward, and two side apertures each of which is defined by a second curve as an inner half arcuated inward and third curve as an outer half arcuated outward, the first and second curves are less arcuated than the third curve, the three apertures being aligned such that major axes thereof are parallel to a shorter axis of the elongated plate and are located at equal intervals and being spaced apart from each other through corresponding bridge portions, and the third curve of each of the two side apertures being apart from a corresponding edge of the elongated plate along a longitudinal direction thereof.

In the electron gun of the above configuration, for convergence of the three electron beams on the phosphor screen, the two side apertures of the focus grid which oppose those of the accelerating grid are eccentric outward with respect to the two side apertures of the accelerating grid. In the case of a multi-stage electron gun, an additional main lens assembly is provided. The additional main lens assembly has at least one grid which has three cylindrical electron apertures aligned in line. The front edges of two side apertures of the cylindrical apertures are included downward toward the central aperture thereof. The additional main lens assembly is arranged in front of, referenced to the cathode, of the main lens assembly.

BRIEF DESCRIPTION OF THE DRAWINGS

FIGS. 11A and 11B are respectively a sectional view and a plan view of an upper focus electrode according to a third embodiment of the present invention;

FIG. 12 is a sectional view showing the main part of an electron gun for a color picture tube according to the third embodiment of the present invention;

FIGS. 13A and 13B are respectively a plan view and a sectional view of the main part of an anode shown in FIG. 12;

DETAILED DESCRIPTION OF THE PREFERRED EMBODIMENTS

The present invention will be described in detail with reference to the accompanying drawings.

Figure 5A:
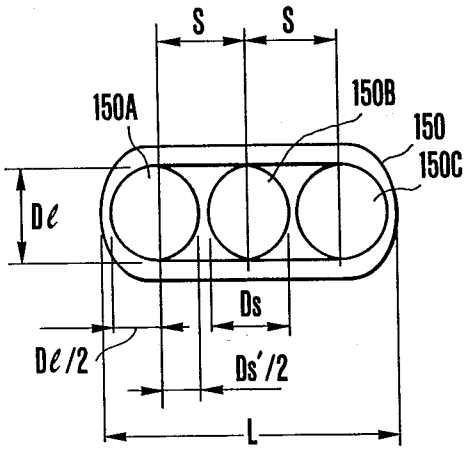
FIGS. 5A and 5B are respectively plan views showing the main part of an upper focus grid of an electron gun for a color picture tube according to a first embodiment of the present invention.
Figure 5B:
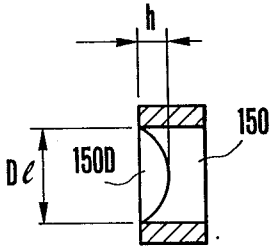

FIG. 5A is a plan view showing the main part of an upper focus grid constituting main lenses in an electron gun for a color picture tube according to a first embodiment of the present invention. Referring to FIG. 5A, an upper focus grid 150 comprises an elliptical plate having a thickness of about 2 mm. A central aperture 150B is an elliptical aperture having a major axis Dl and a minor axis Ds. Each of side apertures 150A and 150C has an outer semicircular portion with a radius Dl/2 and an inner semielliptical portion integral with the outer semicircular portion. The inner semielliptical portion is the same as half of the ellipse of the aperture 150B. The apertures 150A to 150C are aligned in line at a predetermined pitch S. The minor-axis direction of the upper focus grid 150 is parallel to the major axes of the apertures. The major axis Dl can therefore be larger than the pitch S. Unlike the conventional aperture plate, a thick elliptical plate is pressed, so that a bridge portion between every two adjacent apertures and a portion between the end of the elliptical plate and the corresponding side aperture 150A or 150C can be decreased to a bridge as small as about 0.5 mm. Length L of the elliptical plate along the horizontal direction need not be increased. In addition, main lenses comprise the aperture 150A as a combination of the semicircular and semielliptical portions, the aperture 150B as an elliptical aperture, and the aperture 150C as a combination of the semicircular and semielliptical portions. The respective electron beams are strongly focused along the minor-axis direction of the apertures, resulting in astigmatism. In order to correct such astigmatism, an elliptical groove 150D having a major axis DL and a depth h is formed from the center of the central aperture 150B to the centers of the side apertures 150A and 150C, as shown in FIG. 5B. The half of the central aperture is not always identical to the inner portion of each side aperture.

In accordance with the first embodiment, it is generalized that the central aperture has inner and outer portions which are defined by a first curve, and that each of the side apertures has the inner portion defined by a second curve and the outer portion defined by a third curve. The first and second curves are less arcuated. In other words, the first and second curves have a radius of curvature which is larger than that of the third curve.

Figure 1:
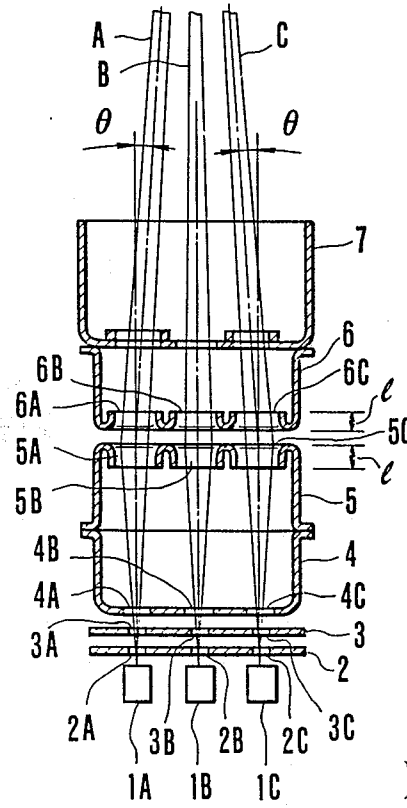
FIG. 1 PRIOR ART
FIG. 1 is a sectional view showing the structure and operation of a conventional in-line electron gun.
Figure 2:
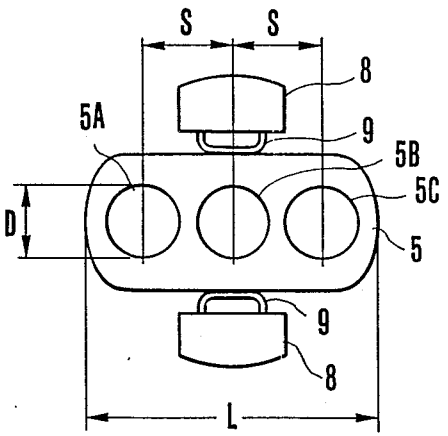
FIG. 2 PRIOR ART
FIG. 2 is a plan view showing the main part of an upper focus grid of the electron gun shown in FIG. 1.
Figure 3:
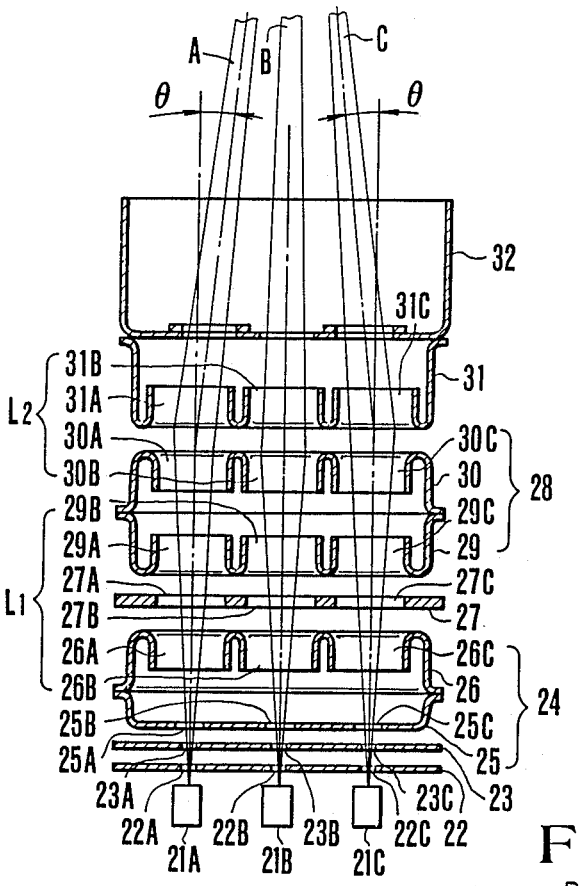
FIG.3 PRIOR ART
FIG. 3 is a sectional view showing the structure and operation of another conventional in-line electron gun with a multi-stage main lens structure.
Figure 4:
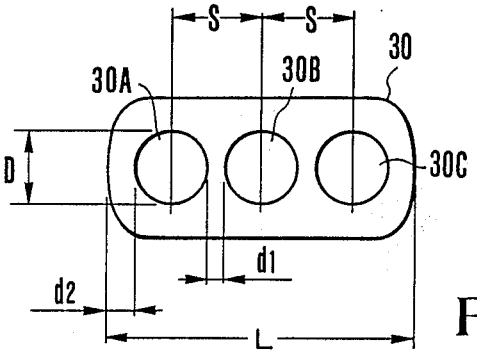
FIG.4 PRIOR ART
FIG. 4 is a plan view showing the main part of an upper fifth grid of the electron gun shown in FIG. 3.
Figure 6:
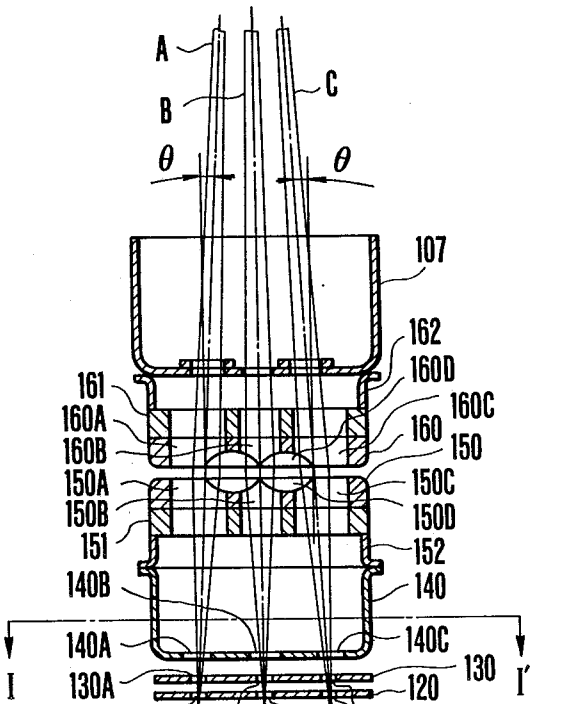
FIG. 6 is a sectional view of an electron gun for a color picture tube according to the first embodiment of the present invention.

FIG. 6 is a sectional view showing an electron gun combined with an electron beam focus system having main lenses and prefocus lenses. The main lenses are constituted such that an anode 160 having the same arrangement of the upper focus grid 150 opposes it. The side prefocus lenses have eccentric arrangements. Referring to FIG. 6, since surface edges of the grid defining the apertures 150A to 150C and apertures 160A to 160C along the minor axes thereof are increased by elliptical grooves 150D and 160D, the diameter of each main lens causing the electron beam to pass therethrough corresponds to the major axis Dl to obtain a substantially, rotationally symmetrical electric field in accordance with a proper depth h.

Referring to FIG. 6, for the electron gun having the upper focus grid 150 and the anode 160, the apertures 150A to 150C and 160A to 160C of the upper focus grid 150 and the anode 160 are formed with high precision in a plate having a maximum thickness of about 2 mm. When an aperture diameter is larger than about 4 mm, the thickness cannot be half of the diameter. In this case, supports 152 and 162 overlap the lower surfaces of auxiliary electrodes 151 and 161 having apertures the same as the apertures 150A to 150C of the upper focus grid 150 and the apertures 160A to 160C of the anode 160, thereby constituting the upper focus grid 150 and the anode 160.

With the above arrangement, the mechanical strength of the main lens electrodes is increased, and the apertures will not be deformed even by stresses caused by multiform glass compression during assembly of the electron gun. Therefore, the main lens diameter is actually increased, and identical components can be used to decrease precision errors. Therefore, the electron gun has improved focusing characteristics.

Figure 7:
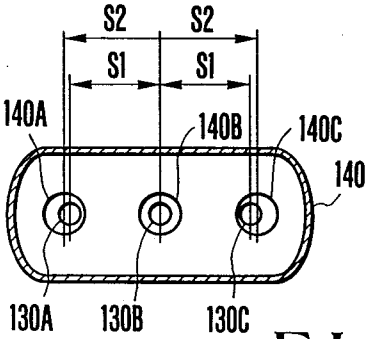
FIGS. 7 and 8 are respectively plan views for explaining an electron beam convergence system combined with the electron gun shown in FIG. 6.

As shown by the sectional view taken along the line I—I' of FIG. 7, the side electron beams are deflected inward by an angle $\theta$ with respect to apertures 120A and 130A and apertures 120C and 130C of control and accelerating grids 120 and 130 since a pitch S2 between a central aperture 140B and a side aperture 140A or 140C of the lower focus grid 140 is larger than a pitch S1 of the apertures 120A to 120C and 130A to 130C in the control and accelerating grids 120 and 130, thereby performing proper convergence. The pitch S1 is slightly larger than pitch S of the main lenses.

Figure 8:
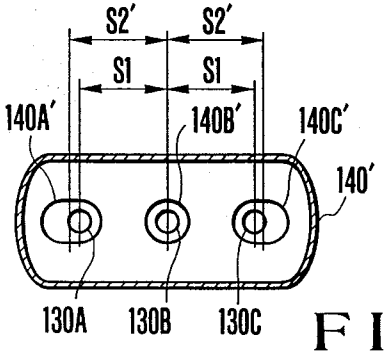

FIG. 8 shows a modification of the structure shown in FIG. 7. In this modification, the side apertures 140A and 140C of the lower focus grid 140 are replaced with horizontally elongated apertures 140A' and 140C' of a lower focus grid 140' so as to converge the side electron beams.

When the central electron beam B has a different shape from the side electron beams A and C, the cross sections of the three electron beams can be made circular by properly selecting the minor axes Ds of the central elliptical aperture 150B of the upper focus grid 150 and the central elliptical aperture 160B of the anode 160, and the half of the minor axis of the inner semielliptical portions of the side apertures 150A, 150C, 160A and 160C.

Figure 9:
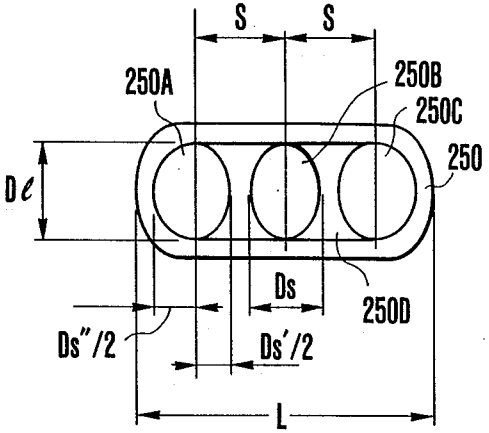
FIG. 9 is a plan view showing the main part of an upper focus grid of an electron gun according to a second embodiment of the present invention.

In order to prevent degradation of picture quality at the peripheral portion of the phosphor screen when the electron beams become horizontally flat at the peripheral portion thereof, an upper focus grid 250 will be described as a second embodiment of the present invention, wherein the electron beam is set to have a vertically elongated cross section, referring to FIG. 9. Referring to FIG. 9, each of side apertures 250A and 250C has an outer semielliptical portion having a major axis Dl and a given minor-axis radius and an inner semielliptical portion having the major axis Dl and a minor-axis radius smaller than that of the given minor-axis radius. The inner semielliptical portion is integrally formed with the outer portion. A central aperture 250B is an elliptical aperture having a major axis Dl. A semielliptical groove is formed in the same manner as in FIG. 5B to prevent astigmatism, thereby obtaining three electron beams whose cross sections are circular.

Figure 10:
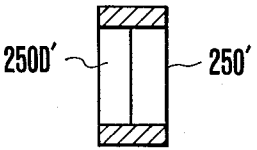
FIG. 10 is a sectional view showing the main part of a modification of the upper focus grid of the electron gun.

In the first and second embodiments, the groove has a semielliptical sectional shape to correct astigmatism. However, the groove can be constituted by a plurality of curves or straight lines which are used to approximate a semiellipse. As a modification, a rectangular groove 250D' may be used to obtain the same effect as the semielliptical groove, a shown in FIG. 10.

An electron gun according to a third embodiment of the present invention will be described with reference to FIGS. 11A to 13B. FIGS. 11A and 11B are respectively a plan view and a sectional view of an upper focus grid of an electron gun for a color picture tube according to the third embodiment. Referring to FIGS. 11A and 11B, an upper focus grid 350 comprises an elliptical plate 351 which has three apertures and a thickness of about 2 mm, and an elliptical ring 352 which has a thickness t and is bonded to the elliptical plate 351. A central aperture 351B of the elliptical plate 351 is an elliptical aperture having a major axis Dl and a minor axis Ds, and each of side apertures 351A and 351C has an outer semicircular portion having a radius Dl/2 and an inner semielliptical portion which is the same as half of the elliptical central aperture 351B and which is integrally formed with the outer semicircular portion in the manner as in the first embodiment. The apertures 351A to 351C are aligned in line at a predetermined pitch S. The major axis Dl can be larger than the pitch S, and the length of the plate 351 along the horizontal direction need not be increased in the same manner as in the first embodiment. The ring 352 is provided to prevent astigmatism. The elliptical ring 352 has substantially the same outer shape as that of the elliptical plate 351 and is bonded to the main lens formation surface of the plate 351 such that the end portions of the ring 352 are constituted by semicircular portions aligned with those of the side apertures 351A and 351C.

FIG. 12 is a sectional view showing the main part of the electron gun wherein an anode 360 having the same structure as the upper focus grid 350 opposes the grid 350. Referring to FIG. 12, a substantially, rotationally symmetrical electric field corresponding to the major axis Dl is formed by the major lens when thicknesses t of elliptical rings 352 and 362 are properly selected since the minor-axis distance between the apertures 351A to 351C and apertures 361A to 361C is increased by the elliptical rings 352 and 362.

In the same manner as in the first embodiment, a maximum thickness of the plate subjected to pressing is about 2 mm when the apertures 351A to 351C of the upper focus grid 350 and the apertures 361A to 361C of the anode 360 are formed with high precision. When the aperture diameter exceeds 4 mm, the thickness cannot be larger than ½ the aperture diameter. In order to resolve this problem, supports 3501 and 3601 overlap rear surfaces of auxiliary electrodes 3500 and 3600 having apertures corresponding to the apertures 351A to 351C and the apertures 361A to 361C, respectively, of the plate 351 and the anode 361.

With the above arrangement, the mechanical strength of the main lens electrodes is increased. The electrodes will not be deformed by stresses caused by compression of multiform glass during assembly of the electron gun. The main lens diameter is equivalently increased, and assembly precision can be improved, thereby obtaining an electron gun having good focusing characteristics.

The convergence of the side electron beams is performed such that a pitch S' between the central aperture 361B and the side aperture 361A or 361C of the anode 360 is larger by 0.1 to 0.15 mm than the pitch S between the central aperture 351B and the side aperture 351A or 351C of the upper focus grid 350, as shown in FIG. 13A. In this case, the electric fields of the side main lenses are distorted, so that the electron beams A and C are slightly vertically flattened as compared with the beam B. In order to correct this tendency, the minor axis Ds' of the central aperture 361B is slightly larger than the minor axis Ds of the central aperture 351B of the upper focus grid 350. In this case, the central electron beam B is slightly vertically flattened in the same manner as the side electron beams A and C. In addition, the thicknesses t of the elliptical ring 352 of the upper focus grid 350 and the elliptical ring 362 of the anode 360 are slightly increased to obtain three electron beams whose cross sections are circular.

In the same manner as in the first embodiment, when the shape of the central electron beam B is different from that of the side beams A and C, the minor-axis radii Ds/2 and Ds'/2 of the central aperture 351B of the upper focus grid 350 and the central aperture 361B of the anode 360, and the minor-axis radius Ds/2 of the inner semielliptical portions of the apertures 351A and 351C and the apertures 361A and 361C are properly adjusted to obtain three electron beams whose cross sections are circular.

The diameter of the neck is decreased in recent color picture tubes so as to decrease deflection power. Along with this tendency, the electron gun housed in the neck of the picture tube is decreased in size and hence the main lens diameter is decreased, thereby degrading the focusing characteristics. Strong demand has arisen for improving focusing characteristics. In the currently commercially available picture tube having a neck diameter of about 22.5 mm, specifications are standardized such that the aperture pitch S is 4.75 mm and an aperture diameter is 3.9 mm. However, in the main lens of the above embodiments, the aperture pitch S is 4.75 mm, the major axis Dl is 5.0 mm, the minor axis Ds is 4.0 mm, and the groove depth h is 1.2 mm for the upper focus grid 150. For the anode 160, the aperture pitch Sp' is 4.85 mm, the major axis Dl is 5.0 mm, the minor axis Ds' is 4.30 mm, and the groove depth h is 1.2 mm. This main lens is equivalent to a lens having a diameter of 5.0 mm and is increased about 1.3 times compared with the lens of the conventional electron gun. The focusing characteristics of the present invention can be improved to equal those of a color picture tube having a neck diameter of about 29 mm.

The thicknesses of the elliptical plates 351 and 361 and the elliptical rings 352 and 362 are limited in pressing. It is difficult to obtain a thickness larger than half the aperture diameter. However, according to a powdered metal technique wherein a metal powder is compressed, molded and baked, a thick plate can be easily obtained. For example, in order to form the upper focus grid 350 and the anode 360 according to the powdered metal technique, a binder such as acrylic resin is mixed in a metal powder such as a stainless metal powder, and the resultant mixture is compression-molded. The resultant structure is prebaked in a reducing atmosphere at a temperature of 600° to 700° C. The prebaked structure is then baked in a vacuum pressure or in a reducing atmosphere at a temperature of 1,200° to 1,300° C. Slight dimensional changes caused by baking are corrected with a sizing press, thereby obtaining high-precision components having higher precision than the conventional thin pressed components.

Figure 14A:
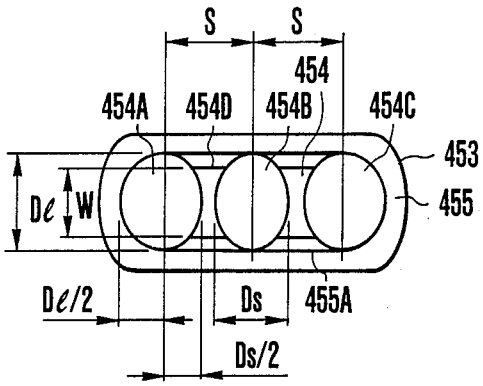
FIGS. 14A and 14B are respectively a plan view and a sectional view of the main part of an upper focus electrode according to a fourth embodiment of the present invention.
Figure 14B:
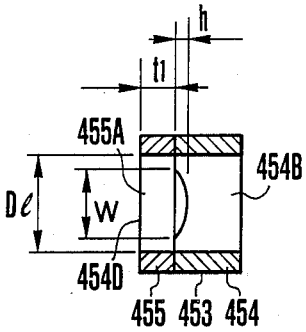

FIGS. 14A and 14B are respectively a plan view and a sectional view of an upper focus grid of an electron gun of a color picture tube according to a fourth embodiment of the present invention. Referring to FIGS. 14A and 14B, three apertures 454A, 454B and 454C are formed in an elliptical plate 454 constituting an upper focus grid 453. A groove 454D having a width W and a depth h is formed in a surface of the elliptical plate 454 which is bonded to an elliptical ring 455. In this case, when the width W is smaller than the major axis Dl and the depth h is properly selected in association with the thickness of the elliptical ring 455, astigmatism can be corrected in the same manner as in the above embodiments. It should be noted that the shape of the groove 454D may be constituted by a plurality of curves or lines.

Figure 15A:
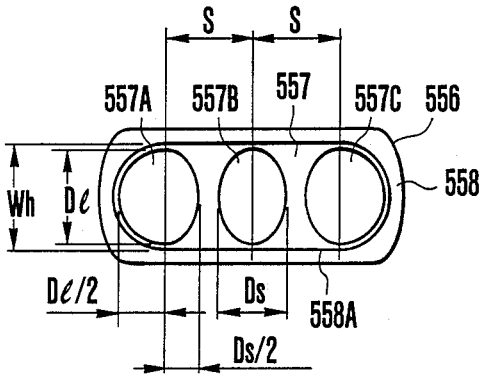
FIGS. 15A and 15B are respectively a plan view and a sectional view of the main part of an upper focus electrode according to a fifth embodiment of the present invention.
Figure 15B:
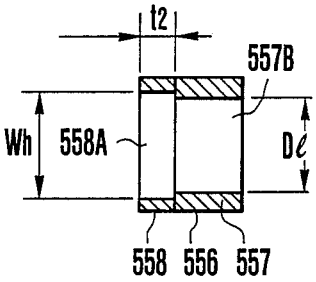

FIGS. 15A and 15B are respectively a plan view and a sectional view of an upper focus grid of an electron gun of a color picture tube according to a fifth embodiment of the present invention. Referring to FIGS. 15A and 15B, an upper focus grid 556 has an elliptical plate 557 with three apertures 557A, 557B and 557C as described above and an elliptical ring 558. With this arrangement, an elongated aperture 558A of the ring 558 has end portions with semicircular portions. These portions have a larger radius of curvature than that of outer semicircular portions of the side apertures 557A and 557C, thereby correcting astigmatism.

According to the electron gun for color picture tubes described above, the main lens diameter can be increased without causing side effects such as tooling problems and degradation of the withstand voltage characteristics. As a result, the focusing characteristics can be improved to obtain a sharp picture with high quality.

In the above embodiments, the present invention is exemplified by the bipotential focusing electron gun, but can be extended to the main lens electrodes of an electron gun of a unipotential type and a multi-stage focus grid type to obtain the same effect as in the above embodiments. A sixth embodiment will be described with reference to FIGS. 16 to 20 wherein the present invention is applied to a multi-stage focus grid type electron gun.

Figure 16:
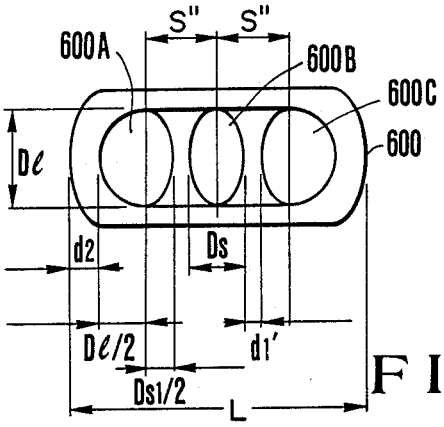
FIGS. 16 and 17 are respectively a plan view and a sectional view of the main part of a fifth grid of an electron gun for a color picture tube according to the present invention.
Figure 17:
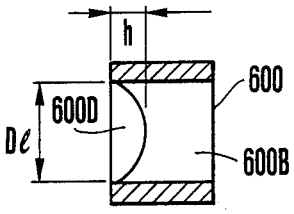

FIG. 16 is a plan view showing the main part of an upper fifth grid 600 constituting a second main lens assembly L2′ in an electron gun with a multi-stage focus grid assembly for a color picture tube. Referring to FIG. 16, the fifth grid 600 comprises an elliptical plate having a thickness of about 2 mm. A central aperture 600B is an elliptical aperture having a major axis Dl and a minor axis Ds. Each of side apertures 600A and 600C comprises an outer semicircular portion having a radius Dl/2 and an inner semielliptical portion which has a major axis Dl and a minor-axis radius $DS\frac{1}{2}$ and which is integrally formed with the semicircular portion. The apertures 600A, 600B and 600C are aligned in line at a predetermined pitch S″. The major axis Dl can be larger than the pitch S″ and a groove 600D is formed to prevent astigmatism in the same manner as in the first embodiment, as shown in FIG. 17. Since the fifth grid 600 is formed by pressing a thick metal plate, length dl′ of the bridge between every two adjacent apertures can be set as small as about 0.5 mm. In addition, even if the pitch S″ is smaller than the conventional pitch S, the length L of the elliptical plate need not be increased. Furthermore, a distance d2 between the edge of the elliptical plate and the side aperture 600A or 600C need not be decreased. The horizontal length of the aperture 600A or 600C can be larger than the diameter D of the conventional aperture, thereby guaranteeing the shielding effect against changes in potential at the inner wall surface of the neck and hence preventing convergence errors. In addition, since the length L of the elliptical plate need not be increased, the diameter of the second main lens assembly L2′ can be increased without degrading the withstand voltage characteristics.

Figure 18:
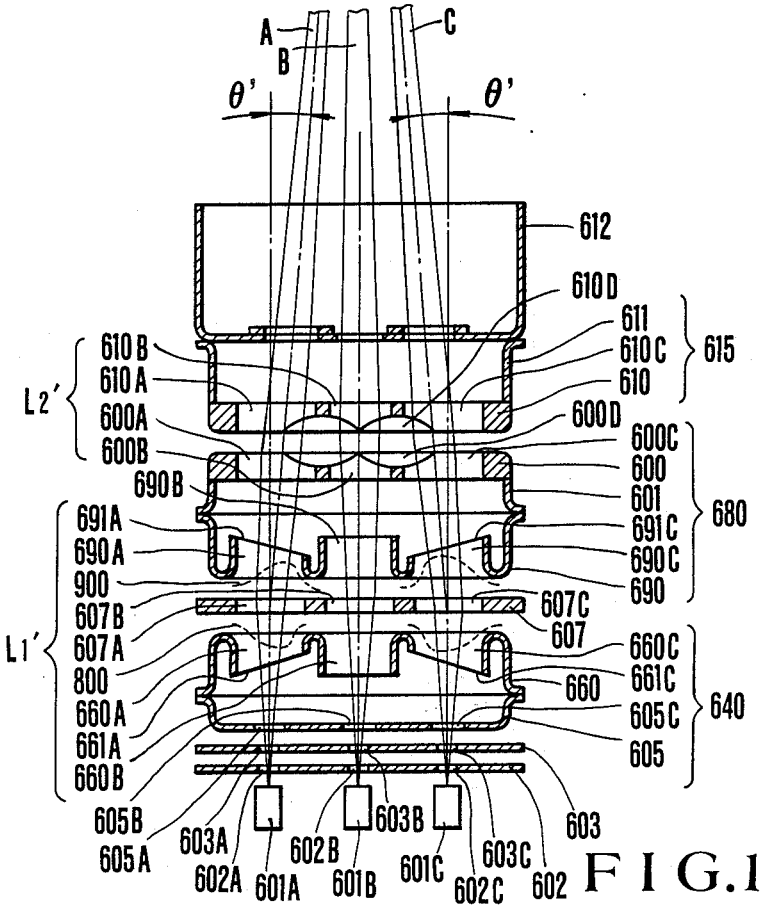
FIG. 18 is a sectional view showing the main part of a multi-stage electron gun for a color picture tube according to a sixth embodiment of the present invention.

FIG. 18 is a sectional view showing the main part of a multi-stage focus type electron gun obtained such that a convergence effect of the side electron beams A and C is derived from the second main lens assembly L2′ having the upper fifth grid 600 and a sixth grid 610 (having the same arrangement as the fifth grid 600 and opposing the fifth grid 600) and a first main lens assembly L1′. Referring to FIG. 18, since the surface edges of the plate defining the grooves 600D and 610D along the minor-axis direction are increased as compared with the case without the grooves, substantially rotatably symmetrical electric fields corresponding to the major axis Dl are formed for beam transmission regions of the beams A, B and C when the depth h of the grooves 600D and 610D, the minor axis Ds of the apertures 600A and 600C and the minor axis $Ds\frac{1}{2}$ of the apertures 610A and 610C are properly selected. Therefore, the beams have a circular cross section. Referring to FIG. 18, apertures 660A, 660C, 690A and 690C of third and fifth grids 660 and 690 constituting the first main lens assembly L1′ opposing a fourth grid 607 have inclined surfaces 661A, 661C, 691A and 691C which are inclined downward toward the central apertures 660B and 690B, respectively. Reference numeral 640 denotes a third grid; 680, a fifth grid assembly; 601, an upper fifth grid; 611, a support; and 615, a sixth grid assembly. With the above arrangement, equal potential curves 700 and 800 of the first main lens assembly L1′ which act on the side electron beams A and C are decreased at their centers in the grids 660 and 690, respectively. Therefore, the electron beams A and C are inclined toward the center at the acceleration grid side. The side electron beams A and C are deflected toward the center at the deceleration electric field side of the grid 690 in the same manner as described above. The inclination angle of the inclined surfaces 661A, 661C, 691A and 691C is adjusted to form a single beam spot on the phosphor screen.

With the above arrangement, the electron beams A and C slightly focused and converged by the first main lens assembly L1′ and the electron beam B slightly focused only thereby are incident on the second main lens assembly L2′. As the detailed arrangement of the second main lens assembly L2′ is illustrated in FIG. 16, the pitch S″ of the apertures of the sixth grid 610 having the same arrangement of the upper fifth grid 600 substantially coincides with the distance between the electron beam paths of the electron beams A and C converged by the first main lens assembly L1′. The second main lens assembly L2′ can focus the electron beams irrespective of the paths of the electron beams. In this manner, the electron beams are converged by the first main lens assembly L1′, the pitch S″ of the second main lenses L2′ can be decreased to eliminate the convergence errors and the degradation of the withstand voltage characteristics, and the diameter of the second main lens assembly L2′ can be increased, thereby greatly improving the focusing characteristics.

Figure 19:
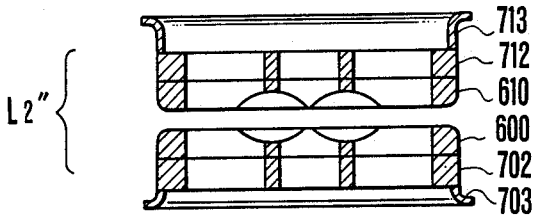
FIGS. 19 and 20 are sectional views showing modifications of second and first main lens assemblies of the electron gun of FIG. 18.

A maximum thickness of the metal plate is about 2 mm when the grids 600 and 610 are pressed with high precision. In order to obtain a desired electric field upon an increase in aperture size, auxiliary electrodes 702 and 712 each having apertures may overlap supports 703 and 713, as shown in FIG. 19.

Figure 20:
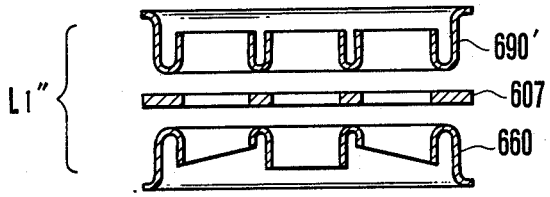

The inclinations of the front edges of the apertures 660A, 660C, 690A and 690C of the grids 660 and 690 need not be formed in both grids. As shown in FIG. 20, inclined surfaces may be formed only in the upper third grid 660. However, such inclined surfaces can be provided for only the lower fifth grid 690.

As shown in FIG. 18, in an electron gun having a multi-stage main lens structure having the first main lens assembly L1' of the upper third grid 660, the fourth grid 607 and the lower fifth grid 690, and the second main lens assembly L2' of the upper fifth grid 600 and the lower fifth grid 610, wherein operating voltages of 0 V, about 700 V, about 7 kV and about 25 kV are respectively applied to the first grid 602, the second and fourth grids 603 and 607, the third and fifth grids 640 and 680, and the sixth grid assembly 615, the inclined surfaces 661A, 661C, 691A and 691C of the upper third grid 660 and the lower fifth grid 690 of the first main lens assembly L1' are inclined to oppose each other, thereby obtaining the convergence described above.

According to the electron gun for the color picture tube of the sixth embodiment, the main lens diameter can be increased without the convergence errors and the degradation of the withstand voltage characteristics, thereby improving the focusing characteristics and hence obtaining a very sharp image with high quality.

What is claimed is:

1. An electron gun for a color picture tube, having at least a cathode, a control grid, an accelerating grid, a focus grid and an anode, each of which has three apertures aligned in line, said focus grid and said anode made of elongated plates serving as main lens electrodes, and said apertures of said focus grid and said anode constituting a main lens assembly, wherein said three apertures of each of said elongated plates comprise a central aperture defined by two first arcuate curves each having a first radius of curvature, and two side apertures each of which is defined by a second arcuate curve having a second radius of curvature and a third arcuate curve having a third radius of curvature, said first and second radii of curvature being greater than said third radius of curvature, said three apertures being aligned such that the major axes thereof are parallel to a shorter axis of said elongated plate and such that said three apertures are spaced apart at equal intervals from each other through corresponding bridge portions, and said third curve of each of said two side apertures being spaced apart from the corresponding edge of said elongated plate along a longitudinal direction thereof: and further including at least one elongated ring bonded to one of the elongated plates of said main lens electrodes adjacent the elongated plate of the other of said main lens electrodes and formed so that said elongated ring surrounds said central aperture and said two side apertures, thereby obtaining three electron beams whose cross sections are circular, said elongated ring thereby reducing astigmatism caused by the passage of said electron beams through said apertures.

2. An electron gun according to claim 1, wherein said two side apertures of said focus grid which oppose those of said accelerating grid are displaced outwardly with respect to said two side apertures of said accelerating grid, thereby converging the electron beams toward a center along be direction of said electron gun.

3. An electron gun according to claim 2, wherein a pitch of main lenses of said main lens assembly is smaller than a pitch between said central aperture and each of said two side apertures of said accelerating grid.

4. An electron gun according to claim 1, wherein said elongated ring has end portions of said third curves aligned with said third curves of said two side apertures.

5. An electron gun according to claim 1, wherein said elongated ring has end portions of fourth curves 6. An electron gun according to claim 2 or 4, wherein a groove is formed in a portion between said major axe of said two side apertures.

7. An electron gun according to claim 6, wherein said groove has a arcuated or rectangular cross section.

8. An electron gun according to claim 1, further comprising another main lens assembly at least one grid of which has three cylindrical apertures aligned in line, front edges of two side apertures of said cylindrical apertures being inclined downward toward a central aperture thereof, thereby constituting a multi-stage main lens structure wherein said another main lens assembly is arranged in front of, referenced to said cathode, said main lens assembly.

9. An electron gun according to claim 8, wherein a groove is formed in a portion between said major axes of said two side apertures.

10. An electron gun according to claim 9, wherein said groove has an arcuated or rectangular cross section.

11. An electron gun according to claim 1, wherein an elongated ring is bonded to the elongated plate of said focus grid adjacent said anode.

12. An electron gun according to claim 11, wherein a further elongated ring is bonded to the elongated plate of said anode adjacent said focus grid.

13. An electron gun according to claim 1 wherein the spacing between the apertures for the outer beams in the lower focus grid is greater than the corresponding spacing between the apertures of the control and accelerating grids for causing the outer beams to swing inwardly to distribute the convergence of the main lens.

14. An electron lens according to claim 13 wherein the outer apertures of the lower focus grid are elongated in the aligned direction.

15. An electron lens according to claim 1 wherein the spacing between the apertures of the main lens is smaller than the aperture spacing in the second grid which spacing of the apertures of the lower focus grid permits the center of the electron beam to pass through the center of the main lens.

16. An electron lens according to claim 1 wherein the main lens has spaced tubular aperture lenses with the said apertures in the respective lenses of identical diameters and oppositely inclined tubular surface apertures in each lens.

* * * * *